United States Patent [19]

Moorhouse

[11] Patent Number: 5,060,494

[45] Date of Patent: Oct. 29, 1991

[54] CYLINDRICAL LOCK STRUCTURE

[76] Inventor: John H. Moorhouse, Clear Lake, Minn. 55319

[21] Appl. No.: 552,155

[22] Filed: Jul. 13, 1990

[51] Int. Cl.[5] ..... E05B 15/14; E05B 63/00

[52] U.S. Cl. ..... 70/419; 70/421

[58] Field of Search ..... 70/419, 421

[56] References Cited

U.S. PATENT DOCUMENTS

| | | | |
|---|---|---|---|
| 2,111,098 | 3/1938 | Segal | 70/419 |
| 2,145,085 | 1/1939 | Heyer | 70/421 |
| 2,222,027 | 11/1940 | Golden et al. | 70/419 |
| 3,197,985 | 8/1965 | Cosio | 70/419 |
| 3,260,082 | 7/1966 | Bodek et al. | 70/421 |
| 3,783,660 | 1/1974 | Gill | 70/419 |
| 3,885,409 | 5/1975 | Genakis | 70/419 |
| 4,068,509 | 1/1978 | Genakis | 70/419 |
| 4,222,252 | 9/1980 | Tietz | 70/419 |

*Primary Examiner*—Gary L. Smith
*Assistant Examiner*—Darnell Boucher
*Attorney, Agent, or Firm*—Leo Gregory

[57] ABSTRACT

A flat key pick resistant cylindrical lock structure which comprises a plug, a sleeve and a housing. The housing is bored off center to receive the sleeve and thus make room for biased split pin tumblers embodying false segments and further, limited misleading internal rotational movement occurs when an attempt is made to pick the lock. Also two shear lines between the plug and sleeve and between the sleeve and housing must be cleared before an unlocking of the lock can be accomplished.

5 Claims, 4 Drawing Sheets

CYLINDRICAL LOCK STRUCTURE

BACKGROUND OF THE INVENTION

1. Field of Invention

This invention relates to a cylindrical pin tumbler lock taking a flat key and having spring biased split pin tumblers embodying false segments and a pair of spaced shear lines required to be cleared.

2. Description of the Previous Art

Cylindrical locks embodying axially aligned rotatable members having pin tumblers are known in the art. Various efforts have been made to develop lock structures resistant to picking or manipulation. Improvement is present in the instant structure in providing false tumblers permitting just sufficient rotational movement therein to misalign the tumbler bores and having two spaced shear lines to be cleared by the tumblers in order to unlock the lock.

An example of the prior art is present in U.S. Pat. No. 541,630 to Ridgway in which a pin lock is disclosed in which a guard is disposed between stationary and movable surfaces in having divided pin tumblers whereby the guard deceives a lock picker.

In U.S. Pat. No. 3,885,409 to Genakis, a pin tumbler lock is disclosed in which a cylinder has a plug or sleeve surrounded by bands or rings, a key way in the plug has top and bottom pins in pinways, each bottom pin has a ball for contact by a key, an attempted pick of the lock offsets the rings to a degree that the lock is inoperable.

The present invention provides substantial improvement in making a lock pickproof.

SUMMARY OF THE INVENTION

The lock structure herein embodies a housing having a sleeve rotatable therein and a plug rotatably disposed in said sleeve with aligned tumblers extending from said plug, through said sleeve and into said housing and shear lines separating said sleeve from said plug and said housing.

The tumblers have false segments whereby said tumblers may be picked to have the plug rotate a limited distance within said sleeve sufficiently to misalign the bores containing the tumblers in said plug with the corresponding bores in said sleeve whereby there is no access to said bores in said sleeve making the lock virtually pickproof and the release of the latch is dependent upon rotation of the sleeve, the continued effort to rotate the plug binds up the segments at the intersections of the segments and the obstructed shear line between the plug and the sleeve.

BRIEF DESCRIPTION OF THE DRAWINGS

FIG. 1 is a longitudinal vertical section of the lock structure herein;

DESCRIPTION OF A PREFERRED EMBODIMENT

Figure 2:
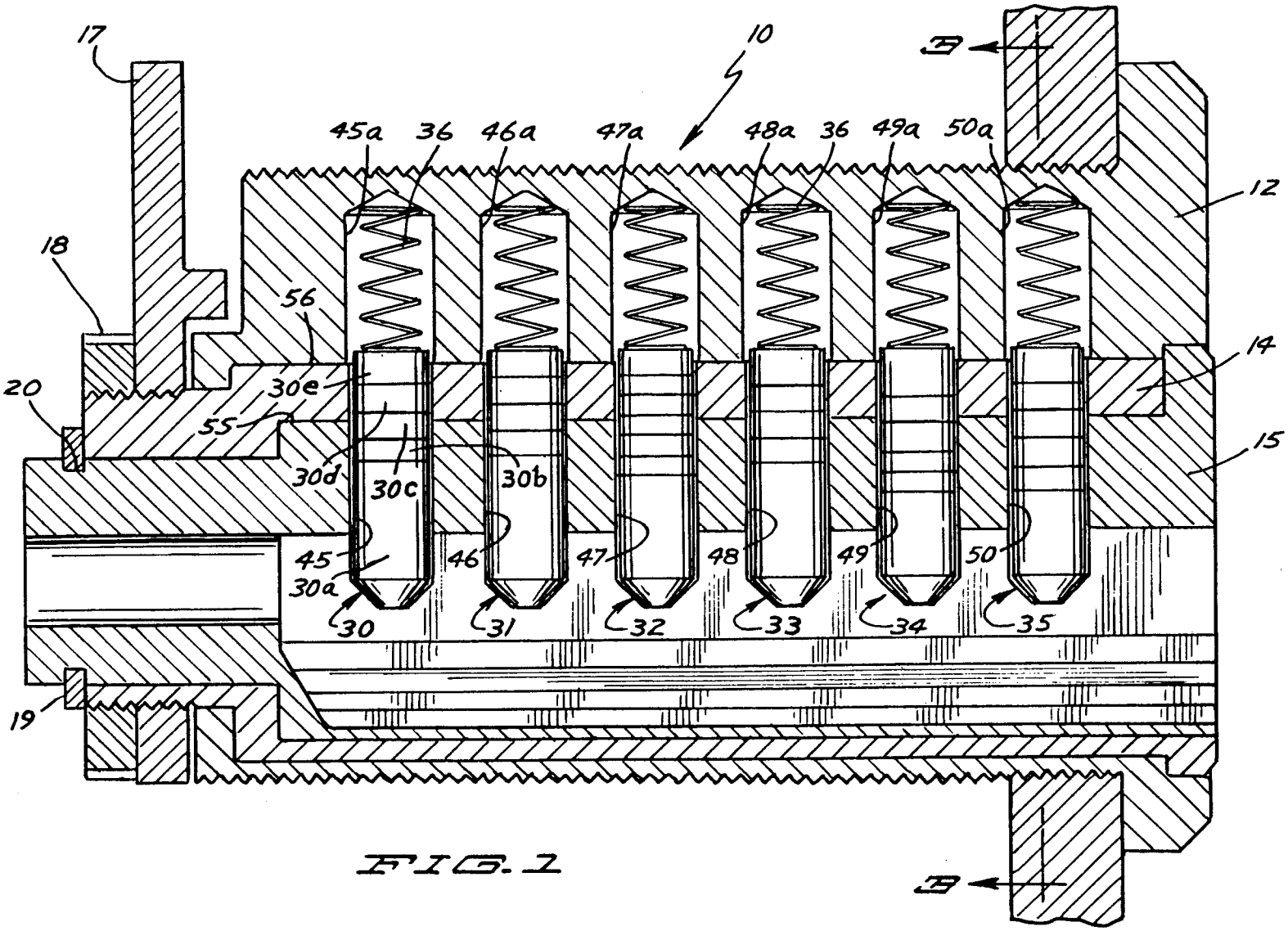
FIG. 2 is a view similar to that of FIG. 1 showing a key in operating position.
Figure 2:
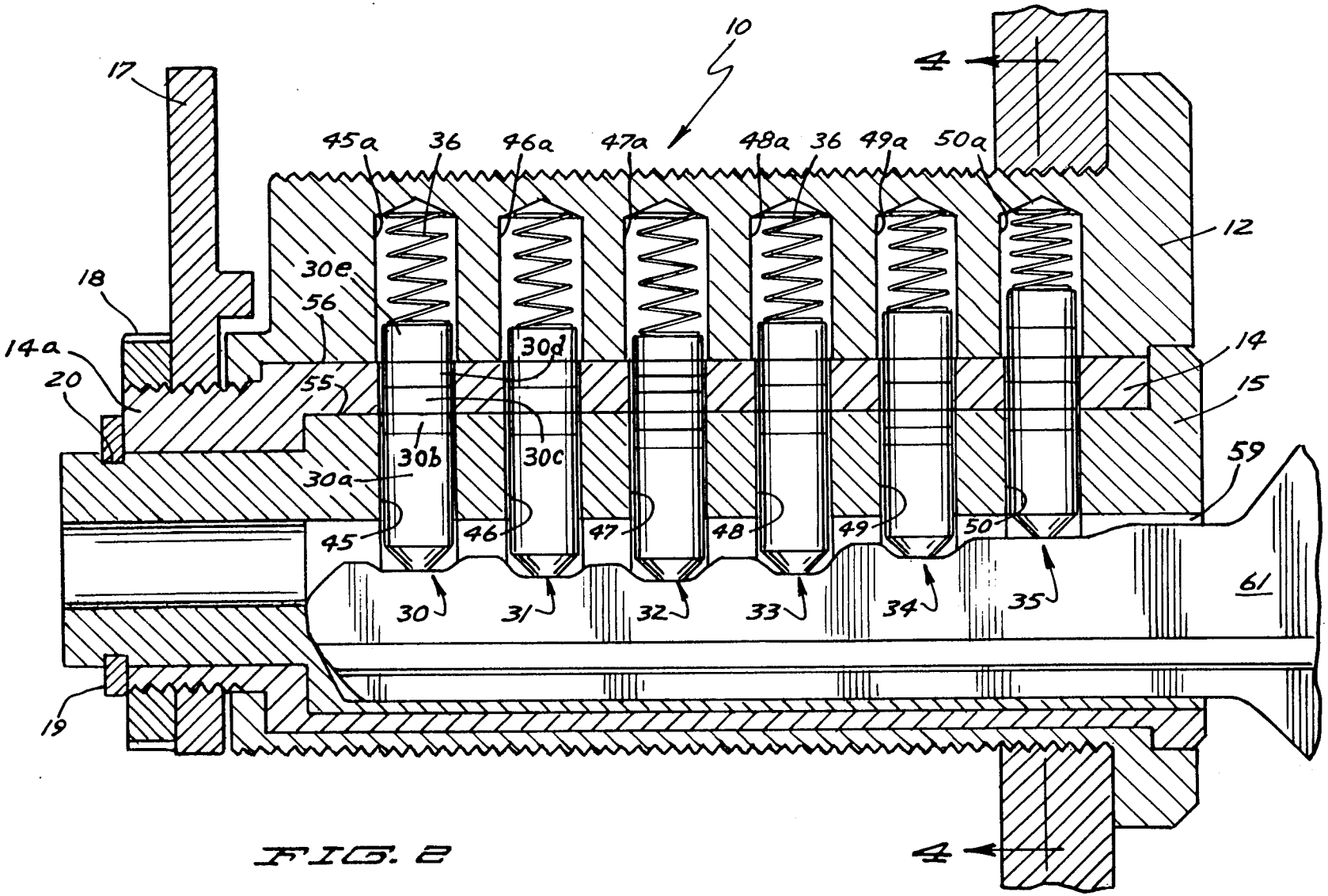
Figure 3:
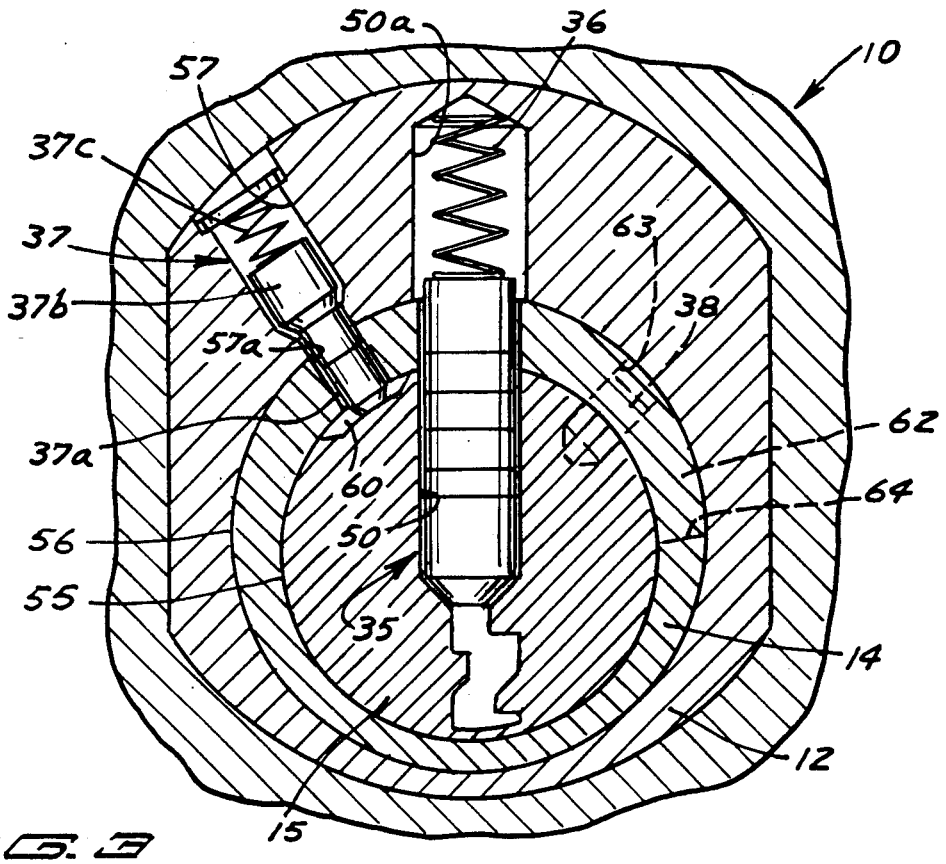
FIG. 3 is a view in vertical cross section taken on line 3—3 of FIG. 1 as indicated showing the lock structure.
Figure 4:
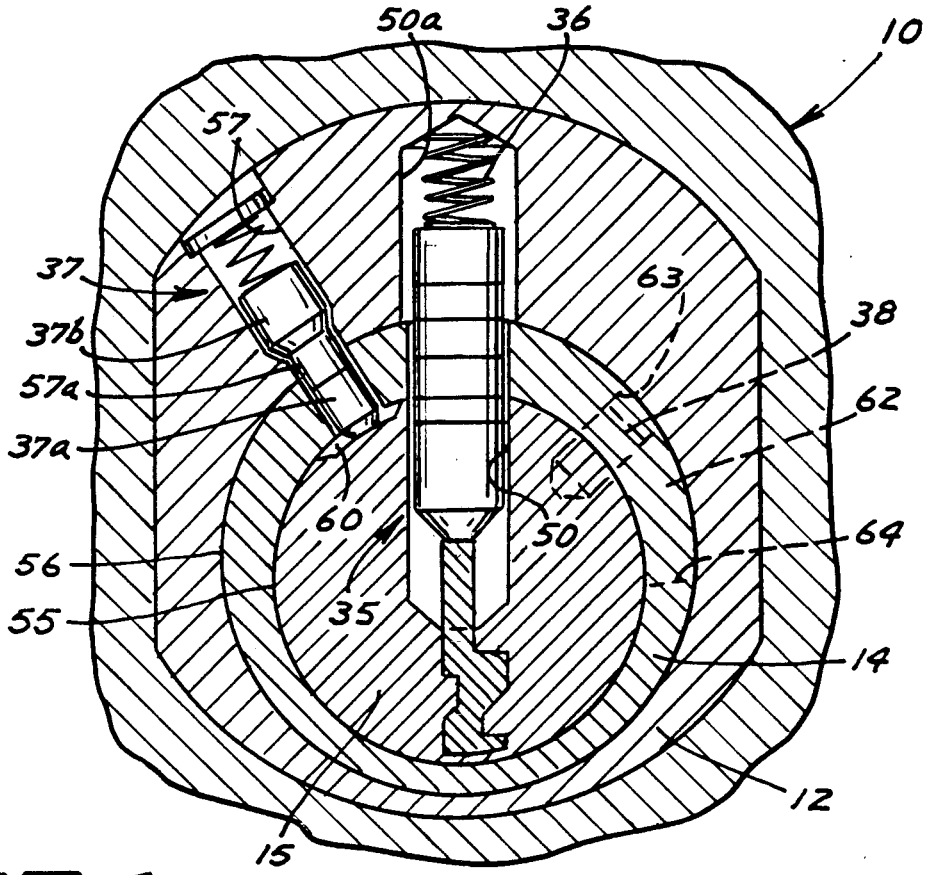
FIG. 4 is a view similar to that of FIG. 3 taken on line 4—4 of FIG. 2 as indicated showing a key inserted engaging the tumbler.

With reference to the drawings and more particularly to FIG. 3, a cylindrical lock structure 10 is shown, the same being adapted to take a flat key and consists of a housing 12 having contained therein a sleeve 14 within said sleeve is a substantially cylindrical member 15 referred to herein as a plug. Said sleeve is bored off center to hold said plug providing space at the upper portion of the sleeve to accommodate tumbler segments as shown in FIG. 4.

Said sleeve is shown being in an off center position within said housing to provide room thereabove for the insertion of tumblers and their springs as will be described and as shown in FIG. 1.

Referring now to FIG. 1, said sleeve 14 at the inner end of said lock structure carries a latch member 17 secured thereto and movable therewith.

Said plug is retained within said sleeve by a snap ring 19 which is held in a groove 20 about the inner end of said plug. The sleeve and latch member are secured to said housing 12 by a nut 18 threaded onto the end 14*a* of said sleeve 14.

Referring to FIG. 1, shown longitudinally vertically disposed are tumblers 30–35. The tumbler 30 having a coil spring 36 thereabove bearing thereagainst consists of a series of segments 30*b*–*d* which in turn are stacked above a pin 30*a*. Said tumbler is representative of the other tumblers, however it is noted that the number of segments with each tumbler may vary and the segments are of varying lengths.

To house said tumblers, said plug and sleeve are bored to have cylindrical cavities or bores 45–50 and said housing 12 has therein corresponding extensions 45*a*–50*a* of said bores. As will be noted, the bores 45*a*–50*a* have larger diameters than their corresponding bores 45–50. The reason for this will be described.

The line of separation between the plug and the sleeve for relative rotation of said plug is denoted as the shear line 55. The line of separation about which said sleeve rotates within said housing is denoted as the shear line 56.

When said tumblers have been positioned by the insertion into the keyway 59 of an appropriate key 61, the tumblers will be positioned to have their respective segments leave unobstructed the shear lines 55 and 56. The key will be notched for an appropriate positioning of the segments of each of said tumblers to be clear of the shear lines and permit the rotation of said plug and sleeve. It will be noted that the latch member 17 is operated by the rotation of the sleeve and not by rotation of the plug.

Figure 5:
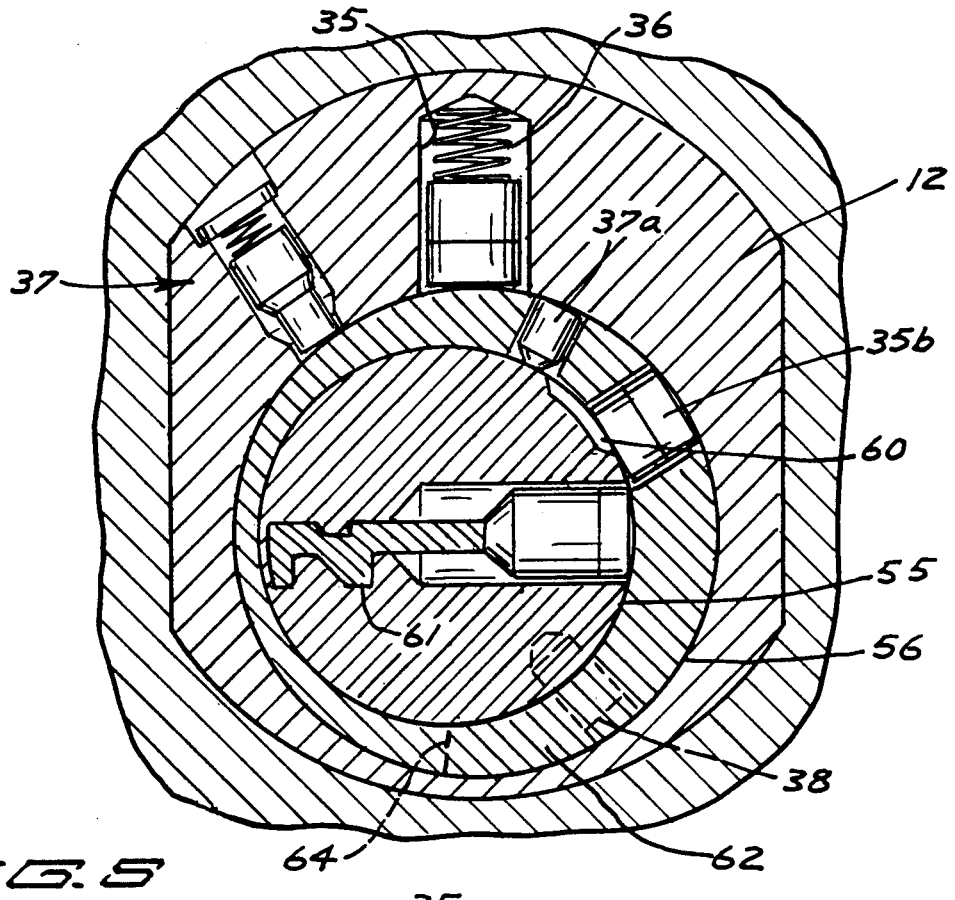
FIG. 5 is a view similar to that of FIG. 4 showing the lock structure in a unlocked position.

Referring now to FIGS. 3–5, a tumbler 37 is shown radially disposed within a bore 57 within said housing 12 and shown extending through a bore 57*a* which is an extension of reduced diameter of said bore 57. Said tumbler extends through said sleeve 14 and has its pin 37*a* disposed into and seated in a fairly shallow slot or channel 60 of a limited length in the adjacent peripheral section of said plug 15. Said pin 37*a* is of a length that is the distance between the shear lines 55 and 56 adjacent said bore 57. By seating in said slot, said tumbler 37 obstructs both shear lines 55 and 56. Biasing said tumbler 37 is a coil spring 37*c*.

To the right of said tumbler 35 as seen in FIG. 3, and being radially disposed relative to said plug and sleeve is a locking pin 38 embedded in the plug 15 and extending into said sleeve 14 and having arcuate movement therein through a slot 62 formed in said sleeve and limited in movement by the end walls or abutments 63 and 64 of said slot.

With the lock 10 in a locked position as in FIG. 4 the key 61 positions the tumblers to have their respective segments clear of the shear lines 55 and 56, the key in rotating the plug 15 moves said plug the length of the slot 60 at which point said plug engages and cams upwardly said pin 37*a* to also clear said shear lines. Further, with the shear lines 55 and 56 clear, the plug will move the locking pin 38 to the end wall 64 of the slot 62 and at this point will further move the plug and sleeve together to the point of fully releasing the latch member. See FIG. 5. A state of the art stopping member is engaged by the latch which prevents further rotation of said plug and sleeve. This stopping member may take various forms as is well known in the art and is not here shown.

To relock the lock, the plug is rotated in the direction opposite that of opening the lock and withdrawal of the key will cause all of the tumbler segments to resume their respective positions in obstructing the shear lines 55 and 56 to prevent rotation of the plug and sleeve.

Now will be described the lock movements resulting from an effort to pick the lock. It will be understood that among the segments are false segments. The tumblers may be picked to have segments arranged to clear the shear line 55 for rotation of the plug up to the end wall 64 of the slot 62 in the sleeve but other segments would obstruct the shear line 56 preventing rotational movement of the sleeve and further rotation of the plug together with the sleeve beyond the wall or abument 64 is required to unlatch the lock.

The tumbler bores in the plug and in the sleeve have the same diameter but the tumbler bores in the housing are larger in diameter. The picking torque applied to the plug will cause the tumblers to bind at the junction of the shear line 55 of the plug and sleeve.

Figure 6:
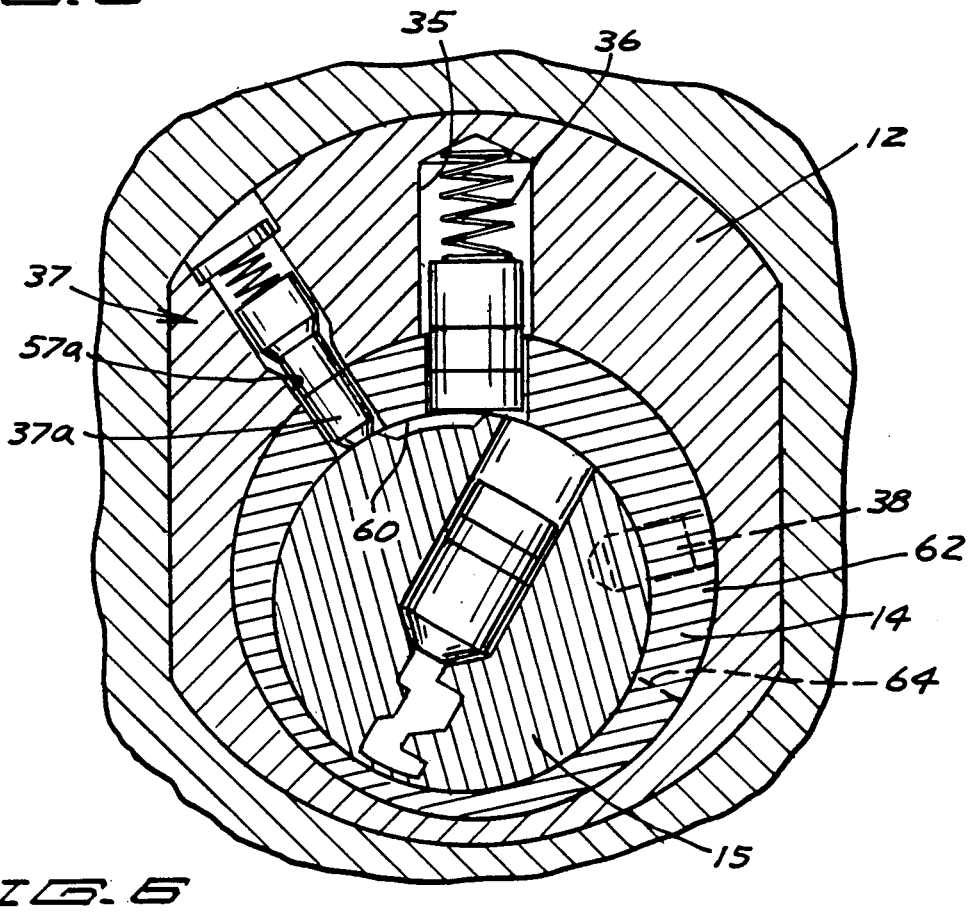
FIG. 6 is a view similar to that of FIG. 5 showing a pick attempt at the lock.

If the picking attempt is successful in clearing the shear line 55 by manipulation of segments, the plug will be rotated and will by cam action urge the pin 37*a* to be clear of the shear line 55. However the sleeve is not free to rotate. Rotation of the plug will cause the pin 38 to move in the slot 62 to the point of the end wall 64 of said slot and at that point the plug and sleeve come to a standstill. The segments of the bores of the plug are out of alignment with the segments of the bores of the sleeve and of the bores of the housing. The picker is prevented from having access to the segments in the housing bores. See FIG. 6.

From the many false segments, the lock picker would have to have found the correct segments to clear the shear lines 55 and 56 in order to unlatch the lock.

Here the locking effort is at a dead end at the abutment 64. There is no further movement of the plug and sleeve.

The lock structure illustrated here provides on the order of 15,625 possible positions in which the segments could be placed by the lock picker and only one of these would operate the lock to unlock the same.

It will of course be understood that various changes may be made in form, details, arrangement and proportions of the product without departing from the scope of the invention which, generally stated, consists in a product capable of carrying out the objects above set forth, in the parts and combination of parts disclosed and defined in the appended claims.

What is claimed is:

1. A rotary lock structure using a key, comprising
a housing,
a sleeve within said housing longitudinally thereof and rotatable therein,
a shear line between said sleeve and said housing,
said sleeve having a longitudinal bore therein,
a plug disposed within said bore of said sleeve and rotatable therein,
a shear line between said plug and said sleeve,
means securing said sleeve and said plug within said housing,
a latch means operable by said sleeve,
a plurality of vertical longitudinally aligned bores extending through said sleeve and through said plug,
said bores extending into said housing with enlarged diameters,
tumblers respectively disposed into said bores and extending into said plug, sleeve and housing,
means in each of said bores urging said tumblers into locking position,
each of said tumblers includes a plurality of segments,
said segments being variable in length,
a particular selective positioning of said segments in each of said bores clears said shear lines,
some of said segments being false segments which unless particularly positioned clear one of said shear lines only for rotation of said plug but not the other of said shear lines for the rotation of said sleeve,
misleading means permitting said false segments partial rotation of said plug and sleeve to the extent of the increase in diameter of said bores in said housing,
a keyway underlying said plug intersecting said bores therein,
a key disposable into said keyway engaging said tumblers in said bores and adapted to position the segments thereof to clear said shear lines for rotation of said plug and said sleeve.

2. The structure of claim 1, said misleading means comprising,
a tumbler radially disposed adjacent one of said tumblers,
a shallow arcuate slot formed in the surface portion of said plug adjacent said tumbler,
said tumbler having a separate segment extending into said slot,
said separate segment having a length not in excess of the distance between said shear lines adjacent said slot,
whereby cam action of said plug upon its rotation urges said segment out of said slot and clear of said shear lines adjacent said slot,
whereby said plug and sleeve have misleading limited rotation to the extent of said slot as limited by lateral movement of said tumblers in the enlarged diameter portions of said tumblers in said housing.

3. The structure of claim 1, including
a pin secured in said plug and extending into said sleeve,
an arcuate slot in said sleeve receiving the portion of said pin extending into said sleeve, and
said slot determining the extent of the rotational movement of said plug relative to said sleeve.

4. A rotary lock structure comprising
a housing a pair of spaced shear lines in said housing, a sleeve within said housing longitudinally thereof and rotatable therein about one of said shear lines, said sleeve having a bore, a plug disposed within said bore of said sleeve and rotatable therein about the other of said shear lines, means securing said plug and said sleeve within said housing, a latch member operable by said sleeve, a plurality of vertical longitudinally aligned bores extending through said sleeve and through said plug, said bores extending into said housing with enlarged diameters, tumblers respectively disposed into said bores and extending into said plug and said sleeve, means causing said tumblers to be urged into locking position in their respective bores, each of said tumblers includes a plurality of segments of variable length, and certain of said segments in said bores can be positioned to clear the shear line for rotation of said plug but not for rotation of said sleeve.

5. The structure of claim 1, wherein said segments are positioned to clear the shear line of said plug, a pin is secured to said plug and extends into said sleeve, an arcuate slot in a peripheral portion of said sleeve adjacent said pin receives the same, said slot has limiting end walls, whereby said plug may rotate relative to said sleeve only to the extent of the length of said slot, whereby said sleeve cannot release said latch member from its locking position.

* * * * *